US005274983A

United States Patent [19]

Sjogren et al.

[11] Patent Number: 5,274,983

[45] Date of Patent: * Jan. 4, 1994

[54] METHOD AND APPARATUS FOR WRAPPING SIGNATURES AND THE LIKE

[75] Inventors: Christer A. Sjogren, Miami; Kevin Cote, Fort Lauderdale; Tuval Kedem, Miami, all of Fla.

[73] Assignee: Quipp Systems, Inc., Miami, Fla.

[ * ] Notice: The portion of the term of this patent subsequent to Apr. 14, 2009 has been disclaimed.

[21] Appl. No.: 868,029

[22] Filed: Apr. 13, 1992

Related U.S. Application Data

[63] Continuation of Ser. No. 666,365, Mar. 6, 1991, Pat. No. 5,103,617.

[51] Int. Cl.[5] ..... B65B 11/08; B65B 27/08; B65B 41/16

[52] U.S. Cl. ..... 53/399; 53/141; 53/176; 53/228; 53/389.4

[58] Field of Search ..... 53/397, 399, 466, 449, 53/141, 176, 580, 586, 228, 389.1-

[56] References Cited

U.S. PATENT DOCUMENTS

| | | | |
|---|---|---|---|
| 2,882,657 | 4/1959 | Fahrenbach | 53/586 X |
| 2,961,814 | 11/1960 | Redmond et al. | 53/389.4 X |
| 3,339,441 | 9/1967 | Haley | 53/389.4 X |
| 3,540,182 | 11/1970 | Price | 53/397 |
| 3,716,960 | 2/1973 | Wright et al. | 53/580 X |
| 3,967,767 | 7/1976 | Seragnoli | 53/389.4 X |
| 4,492,072 | 1/1985 | Miyano et al. | 53/586 |
| 5,009,055 | 4/1991 | Simmons | 53/580 X |
| 5,103,617 | 4/1992 | Sjogren et al. | 53/389.4 X |

*Primary Examiner*—John Sipos
*Assistant Examiner*—Linda B. Johnson
*Attorney, Agent, or Firm*—Louis Weinstein

[57] ABSTRACT

Method and apparatus for wrapping a signature bundle by moving a wrapping sheet into the path of movement of a bundle, said sheet being maintained in self-supporting fashion by imparting a bend thereto as it is fed to the wrapping station. The bundle "crashes" into the sheet causing it to collapse and wrap itself about the bundle. When the wrapping operation is completed, the wrapping sheet is wrapped around three contiguous surfaces of the bundle. The sheet is automatically cut and a new wrapping operation is initiated. The wrapping sheet may be printed upon by an ink jet printing characters "on the fly". The characters are printed backwards and "bleed through" the wrapping sheet to appear in normal manner.

17 Claims, 5 Drawing Sheets

METHOD AND APPARATUS FOR WRAPPING SIGNATURES AND THE LIKE

This is a continuation of application Ser. No. 07/666,365, filed Mar. 6, 1991 now U.S. Pat. No. 5,103,617.

FIELD OF THE INVENTION

The present invention relates to method and apparatus for wrapping bundles and more particularly to a novel method and apparatus for applying a wrapping sheet to a bundle by feeding a wrapping sheet and bending the sheet in such a manner as to render it self-supporting, thereby avoiding the need for conventional mechanical arms which selectively grab, hold and wrap a sheet in front of an oncoming bundle.

BACKGROUND OF THE INVENTION

Signatures, such as newspapers, are typically produced at high production rates of 80,000 or more newspapers per hour. Signatures are delivered from the press, in overlapping fashion and are delivered to stackers which count and stack the newspapers forming bundles of either compensated or non-compensated type, said bundles comprising typically from as few as ten or fifteen newspapers to the order of one hundred newspapers per bundle. When a bundle is completed, it is typically provided with a protective wrap sheet which is wrapped about several surfaces (typically a bottom surface and two contiguous side surfaces) of the bundle whereupon the bundle is then tied with the wrap sheet in place.

Previous techniques employed to wrap a bundle typically utilize an articulated mechanical arm equipped with either suction heads or grippers for grabbing the wrapping paper off of the surface of the conveyor belts carrying the bundles and lifting the wrapping paper above the conveyor belt to form a "wall" of wrapping paper which lies in the path of movement of the approaching bundle. The mechanical arm moves at very high speed between the elevated and withdrawn positions subjecting the mechanical arm to severe wearing. In addition, the movement of the arm creates an extremely hazardous condition to personnel.

It is, therefore, extremely advantageous to provide apparatus for wrapping bundles of signatures, such as newspapers, in a high speed and yet safe manner and through the use of apparatus which does not present a hazard to operating personnel and does not require high speed movement of large mechanical arms.

BRIEF DESCRIPTION OF THE INVENTION

The present invention is characterized by comprising method and apparatus for wrapping signature bundles and the like and which totally eliminates the need for a mechanical arm and suction cups or other gripping means to perform the wrapping operation.

The present invention is characterized by comprising feed rollers for feeding a web from a supply roll of indeterminate length and including means for bending the web in such a manner as to render the web self-supporting as it is moved upwardly to form a wall which lies within the path of movement of approaching bundles.

Conveyor means convey a bundle at a speed sufficient to cause the bundle to crash into the "wall" causing the sheet to lose its ability to be self-supporting and thereby collapse upon the bundle. The bundle is moved past the position occupied by the "wall" causing the sheet to wrap about three contiguous surfaces, including the bottom surface of the bundle whereupon the bundle is delivered to an outfeed location, typically for tying purposes.

The supply roll carrying the wrapping sheet is rotatably supported upon a stationary spindle. The web is fed about a spring-loaded dancer wheel which maintains the web taut as it is being unwrapped from the supply roll. The web passes between roller means having a one-way locking means and feed roller means to be fed through selectively movable roller means for creasing the wrapping sheet to maintain the sheet upright and in the path of an oncoming bundle.

The bundle wrapping technique employs a sensor which detects the approaching bundle. After a predetermined delay, the feed means is activated to drive the web upwardly and into the path of the moving bundle which is advanced toward the "wall" by conveyor means. The web advances to the region between a stationary crease roller and a swingably mounted crease roller which at the extended position provides a gap between the two crease rollers which is slightly larger than the thickness of the wrapping sheet. The web is mechanically deformed to a degree sufficient to render the web rigid so that it remains self-supporting without collapsing.

The swingably mounted crease roller, in the extended position, is engaged by a roller comprising a portion of the conveyor means causing the movable crease roller to be driven to exert a more positive force upon the web as it passes between the movable and stationary crease rollers, the rotation of the swingable crease roller being imparted to the stationary crease roller, when in the extended position.

The conveyor moves the approaching bundle at a velocity sufficient to cause the bundle to crash into the "wall" formed by the wrapping sheet causing the wrapping sheet to lose its self-supporting capability whereupon it collapses upon the bundle, aided by gravity. The velocity of the bundle is sufficient to cause a "natural" wrapping of the sheet about the bundle.

In order to assist the wrapping action, a belt is suspended so that it wipes the bundle and hence the wrapping sheet as it passes therebeneath and serves to flatten the wrapping sheet upon the top of the bundle.

At the same as the bundle crashes into the "wall" formed by the wrapping sheet, the swingable crease roller is retracted enabling the wrapping sheet to be applied to the bottom of the bundle without imparting a crease thereto, since it is not necessary to impart a crease to the portion of the wrapping sheet engaging the bottom of the bundle.

As the bundle passes a predetermined location, a sensor detects the passage of the trailing edge and after a fixed delay activates cutting means for severing the web and simultaneously disabling the feeding means whereupon the wrapping apparatus is ready to receive and wrap the next bundle.

As an optional feature, printing means are provided for printing upon the inside surface of the wrapping sheet, the wrapping sheet being formed of a material which enables the printing ink to "bleed" through the wrapping sheet so as to be easily readable from the exposed surface of the wrapping sheet. Indicia such as alphanumeric characters are printed "backwards" on the covered side of the wrapping sheet engaging the bundle so as to be readable in the normal fashion when observing the exposed surface of the wrapping sheet.

OBJECTS OF THE INVENTION

It is, therefore, one object of the present invention to provide a novel bundle wrapping apparatus which totally eliminates the need for mechanical arms, suction cups and grippers normally utilized to wrap bundles.

Another object of the present invention is to provide a novel method and apparatus for applying a wrapping sheet to a bundle comprising the steps of feeding a wrapping sheet into the oncoming path of an approaching bundle and imparting a bend to the wrapping sheet to render it self-supporting whereupon the bundle crashes into the wrapping sheet at a velocity sufficient to cause the wall formed by the wrapping sheet to collapse upon the bundle.

Still another object of the present invention is to provide means for automatically applying a wrapping sheet to bundles in a successive high speed fashion in which a wrapping sheet is rendered self-supporting and is maintained in the path of movement of an approaching bundle which strikes the "wall" formed by the wrapping sheet at a velocity sufficient to cause the wrapping sheet to collapse upon the bundle.

The above, as well as other objects of the present invention will become apparent when reading the accompanying description and drawings.

DETAILED DESCRIPTION OF THE INVENTION AND PREFERRED EMBODIMENTS THEREOF

Figure 1:
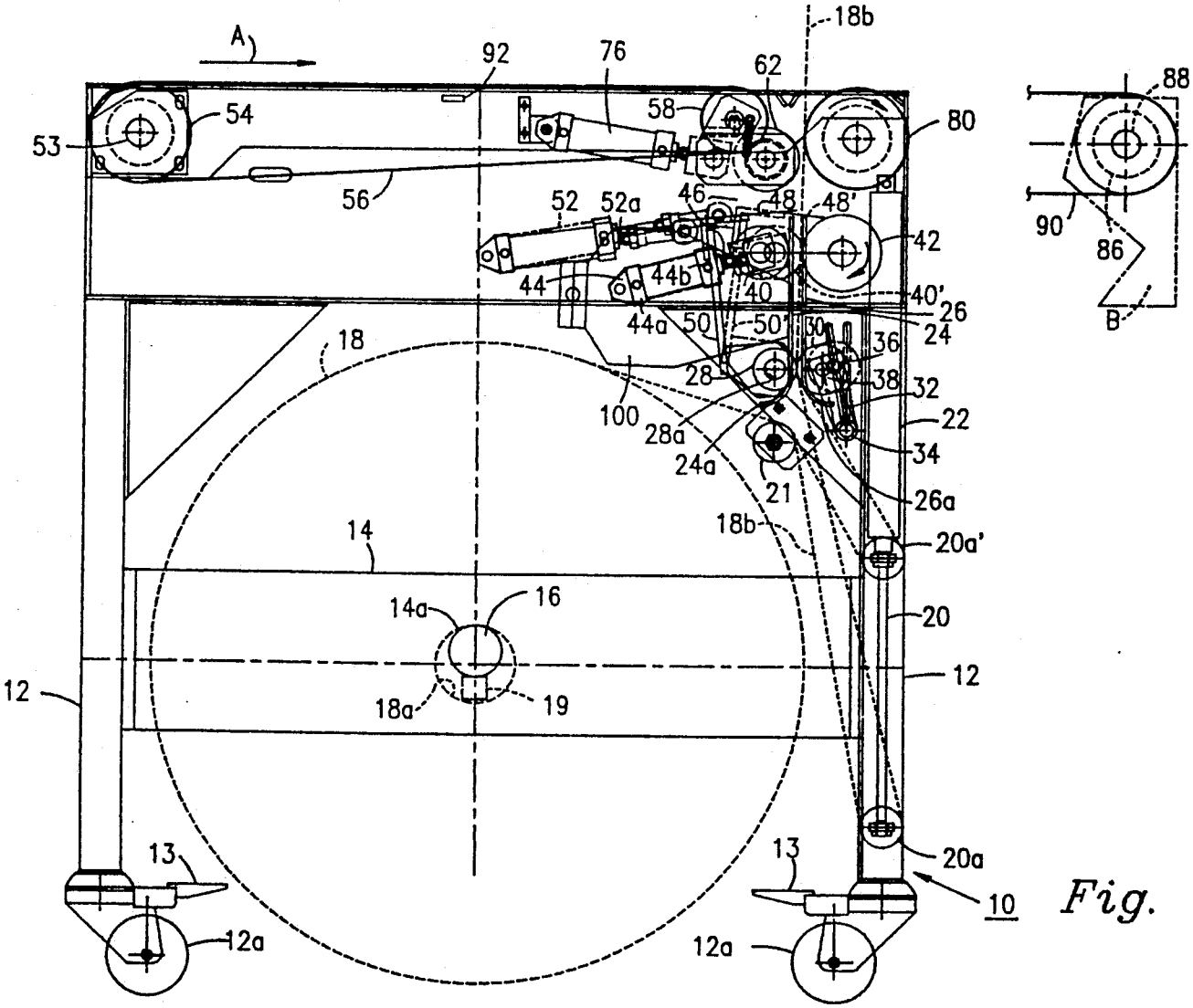
FIG. 1 shows an elevational view of a bundle wrapping apparatus embodying the principles of the present invention.
Figure 2:
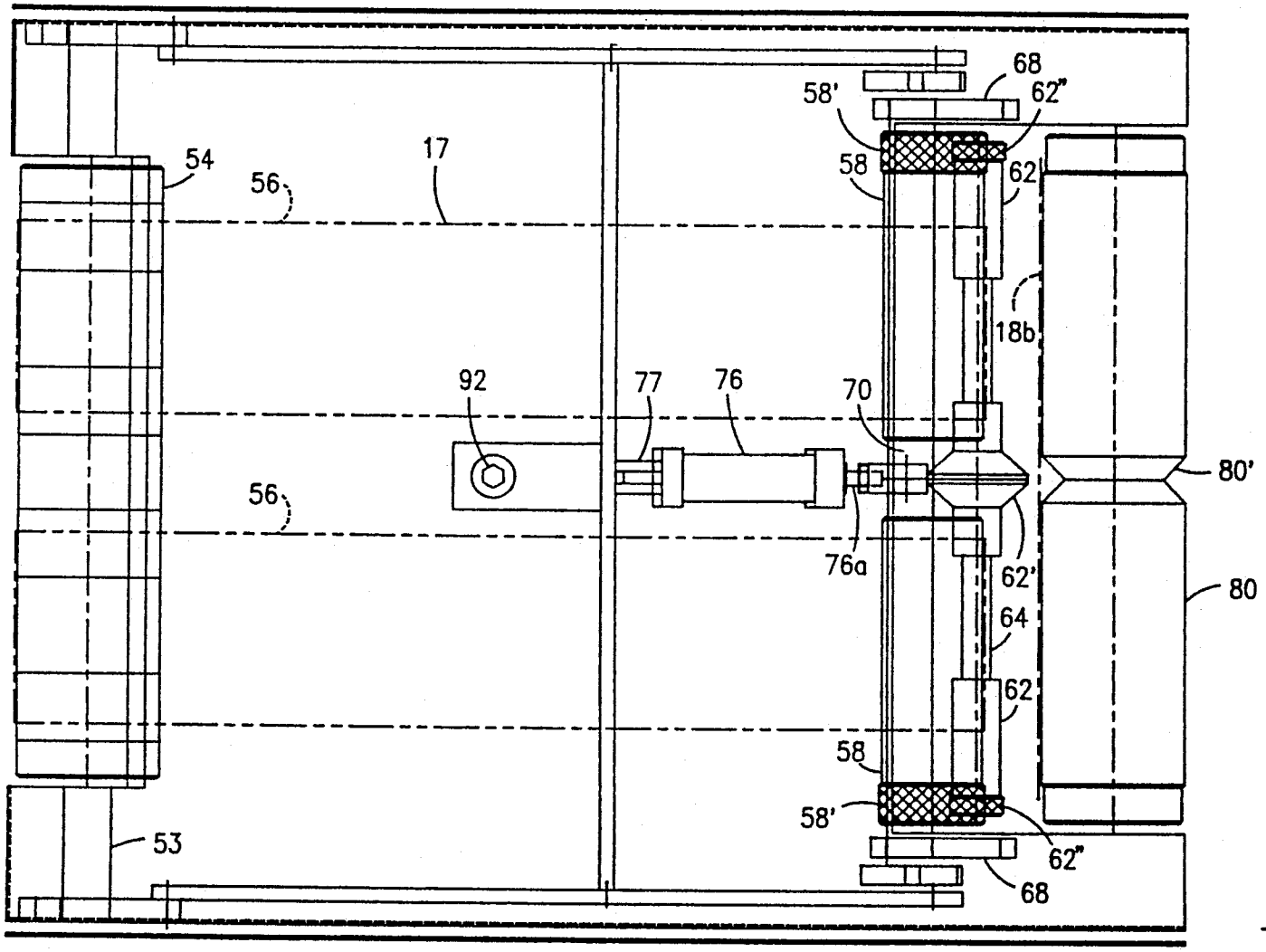
FIG. 2 shows a top plan view of the bundle wrapping apparatus of FIG. 1.
Figure 3:
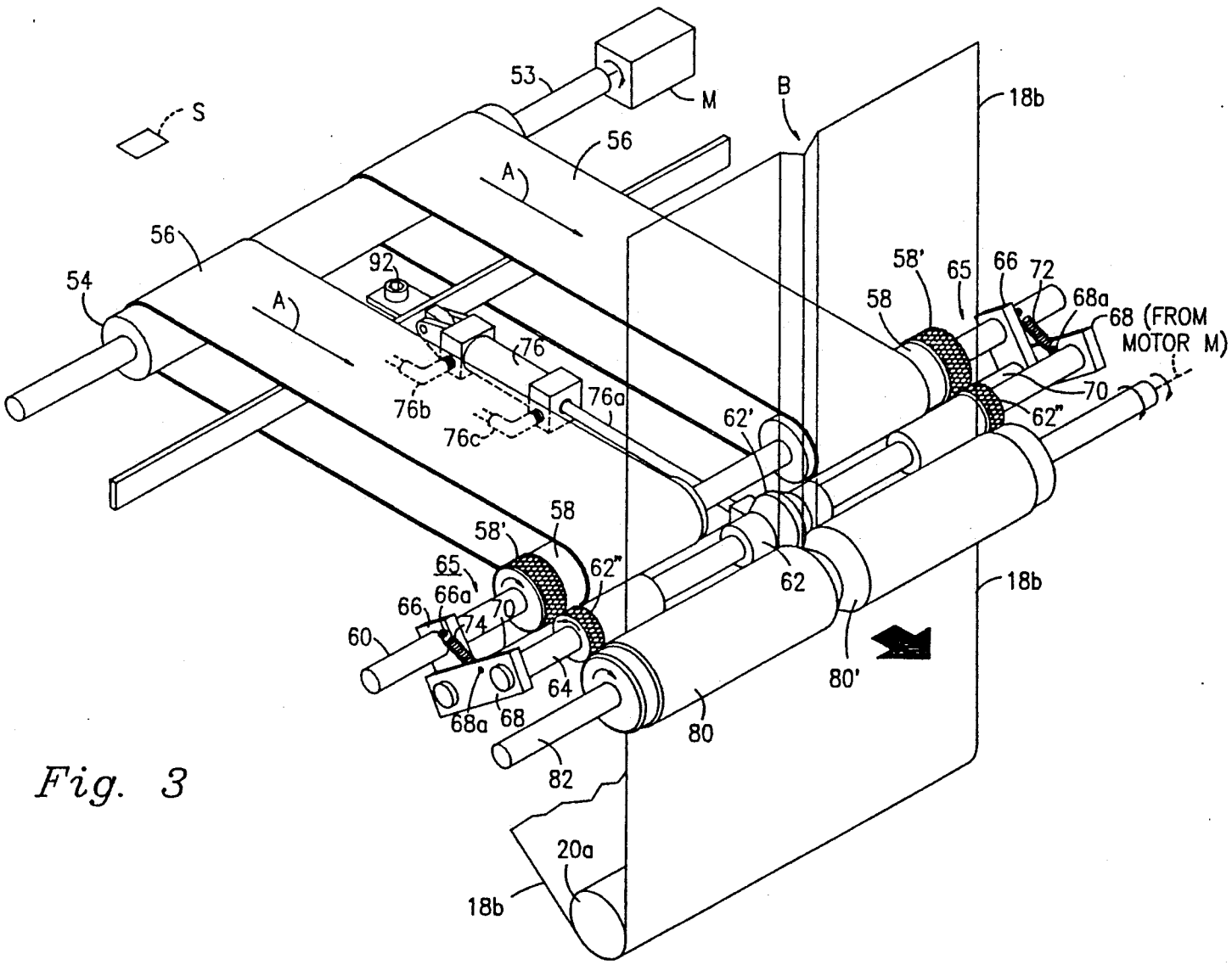
FIG. 3 shows a perspective view of the feeding and creasing portion of the wrapping apparatus of FIG. 1.

FIGS. 1–3 show a bundle wrapping apparatus 10 having four support legs 12 (only two of which are shown in FIG. 1) supporting the wrapping apparatus. A plate 14 is secured to the legs 12 shown in FIG. 1. An elongated spindle 16 has one of its ends welded or otherwise secured to the interior surface of plate 14 and extends inwardly in the direction of the rearward legs 12 which are not seen in FIG. 1 The cantilevered spindle 16 receives a supply roll 18 containing an elongated web 18*b* of indeterminate length wrapped about a central core 18*a* which telescopingly receives spindle 16. Supply roll 18 is normally free to rotate about spindle 16. A brake mechanism 19, shown in schematic fashion in FIG. 1, serves as a braking means for halting the rotation of supply roll 18 to consequently halt the feeding of the free end of the web 18*b* for purposes to be more fully described.

All of the legs 12 are provided with wheels or rollers 12*a* to facilitate movement and positioning of the apparatus 10 and is further provided with braking means 13 for locking the wheels against rotation when the apparatus 10 is properly positioned.

The free end 18*b* of the web 18 extends from the outer surface of the supply roll and about a dancer roll 20*a* mounted on the free end of a dancer arm 20 which comprises a piston rod cooperating with a cylinder 22 containing either spring means or pneumatic means for urging piston rod 20 downwardly and capable of enabling the piston rod 20 to move from its extreme downward position occupied by roller 20*a* to the extreme upward position shown by roller 20*a'* which movement occurs as a result of the force applied to the dancer arm by the web 18*b* during operation, as will be more fully described.

Web 18*b* is further partially wrapped around a stationary mounted rotatable roller 21 positioned between the supply roll 18 and dancer arm 20. The web then extends upwardly and passes through a pair of guide plates 24, 26 having curved lower ends 24*a*, 26*a* which serve to guide the web into the region between plates 24 and 26.

Plates 24 and 26 are further provided with openings enabling portions of the back stop rollers 28, 30 to extend therethrough. Roller 28 is mounted in a stationary fashion and is adapted to rotate in a free-wheeling manner about mounting rod 28*a*. Roller 30 is spring-loaded by spring means 32 mounted to a support plate by pin 34 and engaging the movable back stop roller shaft 36 to normally urge roller 30 in the counterclockwise direction so as to extend through the opening in plate 26 and to engage the surface of roller 28.

The roller 30 further incorporates a one-way clutch mechanism 38 which is mounted between roller 30 and shaft 36. The one-way clutch mechanism permits roller 30 to rotate clockwise relative to FIG. 1 while preventing it from rotating counterclockwise in order to permit forward feeding of the web 18*b* while preventing reverse feeding of the web, as will be more fully described.

The stationary back stop roller 28 incorporates standard ball bearings. When the back stop rollers 28 and 30 are pressed together, web 18*b* is prevented from gliding in the downward direction. The one-way clutch 38 allows the web 18*b* to glide upwardly without any resistance.

The upper portion of guide plates 24 and 26 are each provided with openings to permit feed rollers 40 and 42 to extend therethrough. Feed roller 40 is rotatable about its central axis and is also movable from a position displaced from feed roller 42 to a position 40' shown in dotted fashion where feed roller 40 extends through the opening in plate 24 and engages feed roller 42. The movement of feed roller 40 is provided for by cylinder 44 having a piston rod 46. Cylinder ports 44*a* and 44*b*, when a fluid under pressure is respectively applied thereto, move the piston rod 46 and hence roller 40 to the engaged or displaced position respectively.

Web 18*b* extends between feed rollers 40 and 42 and when the feed rollers are engaged and roller 42 is motor driven, the web is fed in the upward vertical direction.

A knife blade 48 mounted upon an angle arm 50 rotatable about shaft 28*a* is moved between its displaced position 48 and a cutting position 48' by means of a knife cylinder 52 having a piston 52*a* pivotally coupled to angle arm 50 for moving the angle arm 50 from the displaced position 50 to the cut position shown in dotted fashion at 50' in order to cut the web as will be described in greater detail hereinbelow.

An electric motor M drives roller shaft 53 and hence roller 54. Belts 56 are entrained about roller 54 and rollers 58 secured to shaft 60 whereby motor M causes rotation of rollers 58 and 54 to move belts 56 in the direction shown by the arrows A.

Figure 4A:
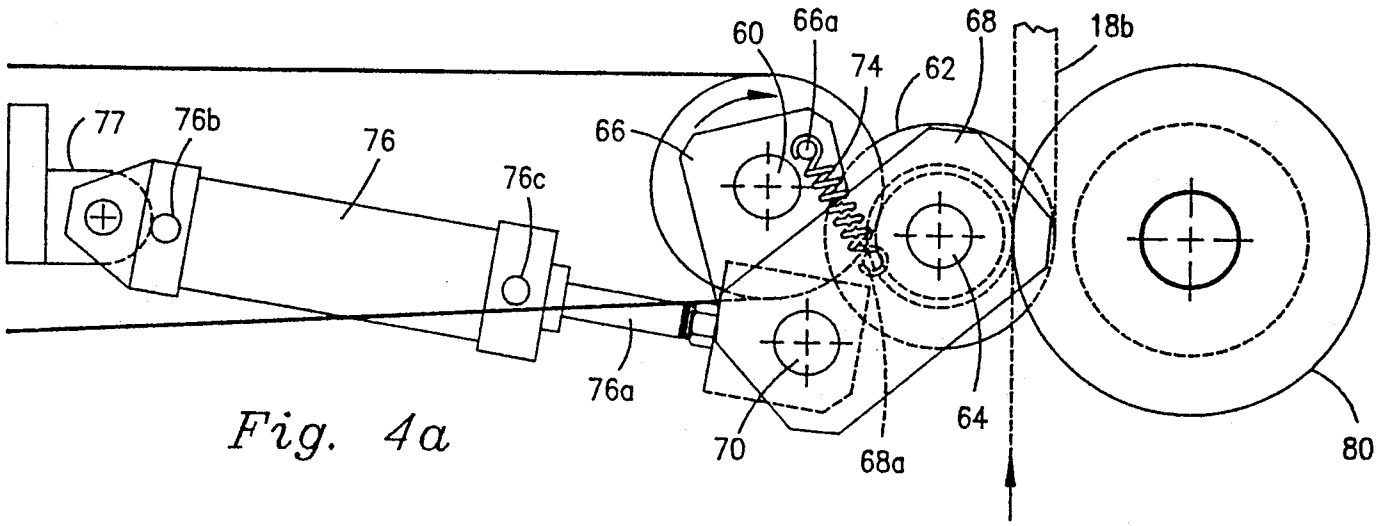
FIGS. 4*a* and 4*b* show side elevational views of a portion of the conveying and sheet creasing apparatus of FIG. 3 respectively showing the operating cylinder for moving the creasing roller in the extended and retracted position.
Figure 4B:
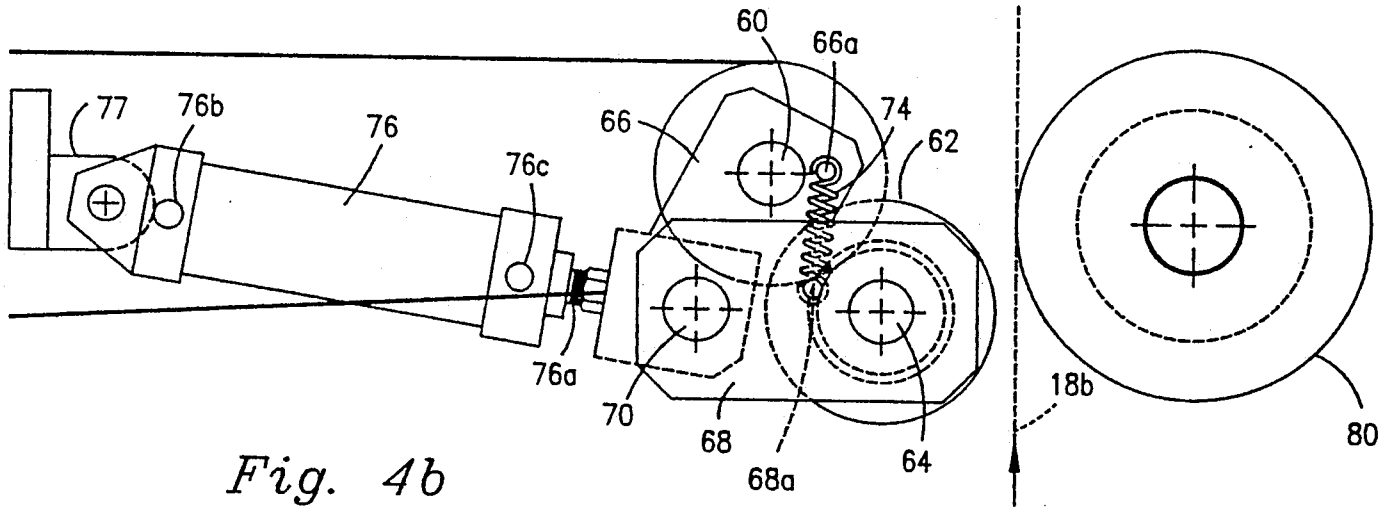

A movable crease roller 62 is swingable between a position displaced from the stationary crease roller 80 as shown in FIG. 4*b* and a position in close proximity to the stationary crease roller for creasing the web 18*b* (as will be more fully described) as shown in FIG. 4*a*.

The mounting assembly for the swingable crease roller comprises a pair of bracket assemblies 65 each incorporating a first bracket 66 whose upper end is swingably mounted about shaft 60 and a lower end which receives elongated rod 70. A second bracket 68 has its lower end pivotally mounted to rod 70 and its upper end secured to shaft 64. A spring 74 has one end engaging a pin 66*a* on bracket 66 and has its opposite end engaging a pin 68*a* mounted on bracket 68. The springs 74 normally urge the traction surfaces 58' and 62' of the rollers 58 and 62 into engagement with one another.

Swingable movement of crease roller 62 is obtained by operation of the crease cylinder 76 which is provided with a piston arm 76*a* pivotally coupled to rod 70 as shown best in FIGS. 4*a* and 4*b*. The left-hand end of crease cylinder 76 is pivotally mounted to a support bracket 77, as shown. Appropriate control ports 76*b*, 76*c* selectively receive a fluid under pressure for moving the piston rod respectively to the positions shown in FIGS. 4*a* and 4*b*.

Crease roller 80 is fixedly mounted to shaft 82. Shaft 82 is driven by motor M through a timing belt (not shown for purposes of brevity). The crease roller 62 is fixedly secured to shaft 64 which is rotatable relative to brackets 68. Rollers 58 are free-wheelingly mounted about shaft 60 and are rotated by conveyor belts 56, as was previously described.

The apparatus 10 of FIG. 1 may be positioned so that the stationary crease roller is located immediately adjacent a take-off conveyor. Alternatively, an additional conveyor section comprised of a roller 86 which is supported upon suitable bracket means B, may be provided. Conveyor belts 90 are entrained about auxiliary roller 86 and stationary crease roller 80 in order to accommodate installations which prevent the stationary crease roller from being positioned in close proximity to a take-off conveyor, which take-off conveyor is then positioned in close proximity to the supplementary roller 86.

The central portion of swingable crease roller 62 comprises a male portion 62' which cooperates with a female portion 80' of stationary crease roller 80.

The operation of the apparatus 10 is as follows:

A bundle adapted to receive a wrapped sheet is fed from suitable conveyor means (not shown) to a position whose downstream end is positioned adjacent roller 54 whereupon the bundle which has a substantially parallelepiped shape and is comprised of signatures (i.e. newspapers) relatively neatly stacked (for example, in bundles of fifty, seventy-five, one hundred or one hundred twenty-five signatures). The bundle is transferred to belts 56 and a sensor means, such as, for example, a light source and cooperating light sensor S positioned upstream relative to conveyor belts 56 senses the movement of a bundle approaching the wrap machine 10. Alternatively, a signal from an upstream stacker (not shown) forming the bundles can be used to warn that a completed bundle is being ejected from the stacker.

After an adjustable delay from receipt of the signal from sensor means S (or stacker) which period is controlled according to the length of wrapping paper desired, feed cylinder 44 is operated to extend its piston rod 46 and thereby move feed roller 40 into engagement with stationary feed roller 42. At this time, the free end of web 18*b* extends to a position just above the top of guide plates 24 and 26 having been previously severed by cutting blade 48 during a previous wrapping operation. The closure of feed cylinder 44 causes rollers 40 and 42 to rotate, stationary roller 42 being driven by either motor means M through a suitable power train conveying means such as belt means or the like, or alternatively, by a separate motor means.

In the resting mode, before the approaching bundle is detected, the motor means drives belts 56, stationary crease roller 80 and stationary feed roller 42.

The web of wrapping paper 18*b* is threaded about the rollers 21, 20*a*, between rollers 28 and 30 and between rollers 40 and 42. The top edge of the web was previously cut off by the knife blade 48 and thus the end of the web is now slightly above the guide plates 24 and 26 and extends up to the path of movement of the knife.

The crease air cylinder 76 is in the retracted position, displacing the movable crease roller 62 from the stationary crease roller 80 as shown in FIG. 4*b*.

The knife cylinder 52 maintains the knife blade 48 in the retracted position and the feed cylinder 44 maintains the movable feed rollers 40, 42 in the displaced position.

The movable back stop roller 30 is spring-loaded against stationary back stop roller 28 and the one-way clutch prevents the web from moving downwardly. In this stationary position, the dancer arm 20 is free to move downwardly from the position 20*a'* to the position 20*a*.

When the electrical signal generated by sensor S which senses an approaching bundle is detected, after the aforementioned predetermined delay, feed cylinder 44 moves feed rollers 40 into engagement with stationary feed rollers 42. Since stationary feed roller 42 is positively driven by the motor means, web 18*b* moves in an upward direction.

As the leading edge of web 18*b* passes beyond the horizontal centerline of the stationary crease roller 80, the crease air cylinder 76 is operated to extend its piston rod 76*a* and with it the movable crease roller 62.

At the extended position, the horizontal centerline of the two crease rollers 62 and 80 are approximately in alignment. The male portion 62' of movable crease roller 62 mates with the female portion 80' of stationary crease roller 80. The surfaces of these male and female portions do not engage one another but are arranged to provide a gap which is slightly larger than the thickness of the wrapping paper. The male and female portions define a substantially V-shape therebetween, through which the web 18*b* passes.

The mechanical deformation of web 18*a* as it passes between the crease rollers is sufficient to cause the web to assume an upright position as shown, for example, in FIGS. 3 and 4*a*, the crease comprising a V-shaped bend B serving to rigidify the upwardly extending web. The web thus moves in an upward vertical direction and is prevented from collapsing due to the bent or creased portion B. The creased portion will support the web in the upright position for heights of greater than forty inches.

Belt pulley or roller 58 is an idler and is driven by the belts 56. The belt pulleys 58 are each provided with traction surfaces 58' at opposite outer ends of the pulleys.

The movable crease roller 62 is spring-loaded so that its traction surfaces 62'', 62'' engage traction surfaces 58', 58' whereby the crease rollers 62 and 80 are positively driven to yield a more positive force which is applied to web **18*b* as it passes between crease rollers 62 and 80**.

Figure 5A:
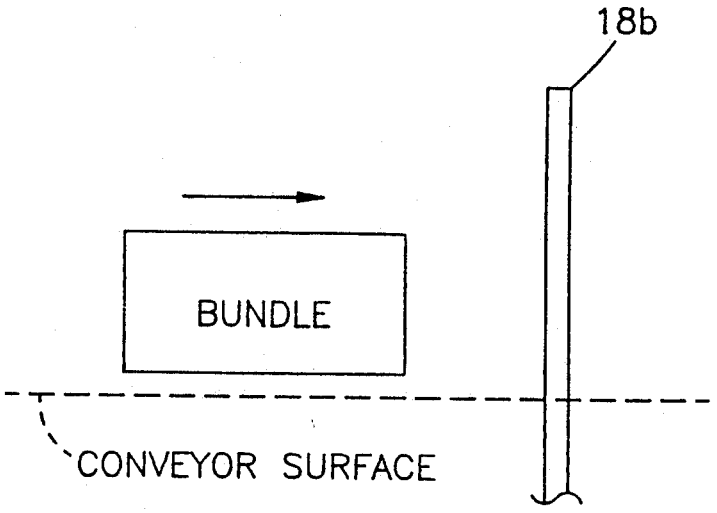
FIGS. 5*a* and 5*b* are diagrams useful in describing the operation of the present invention.
Figure 5B:
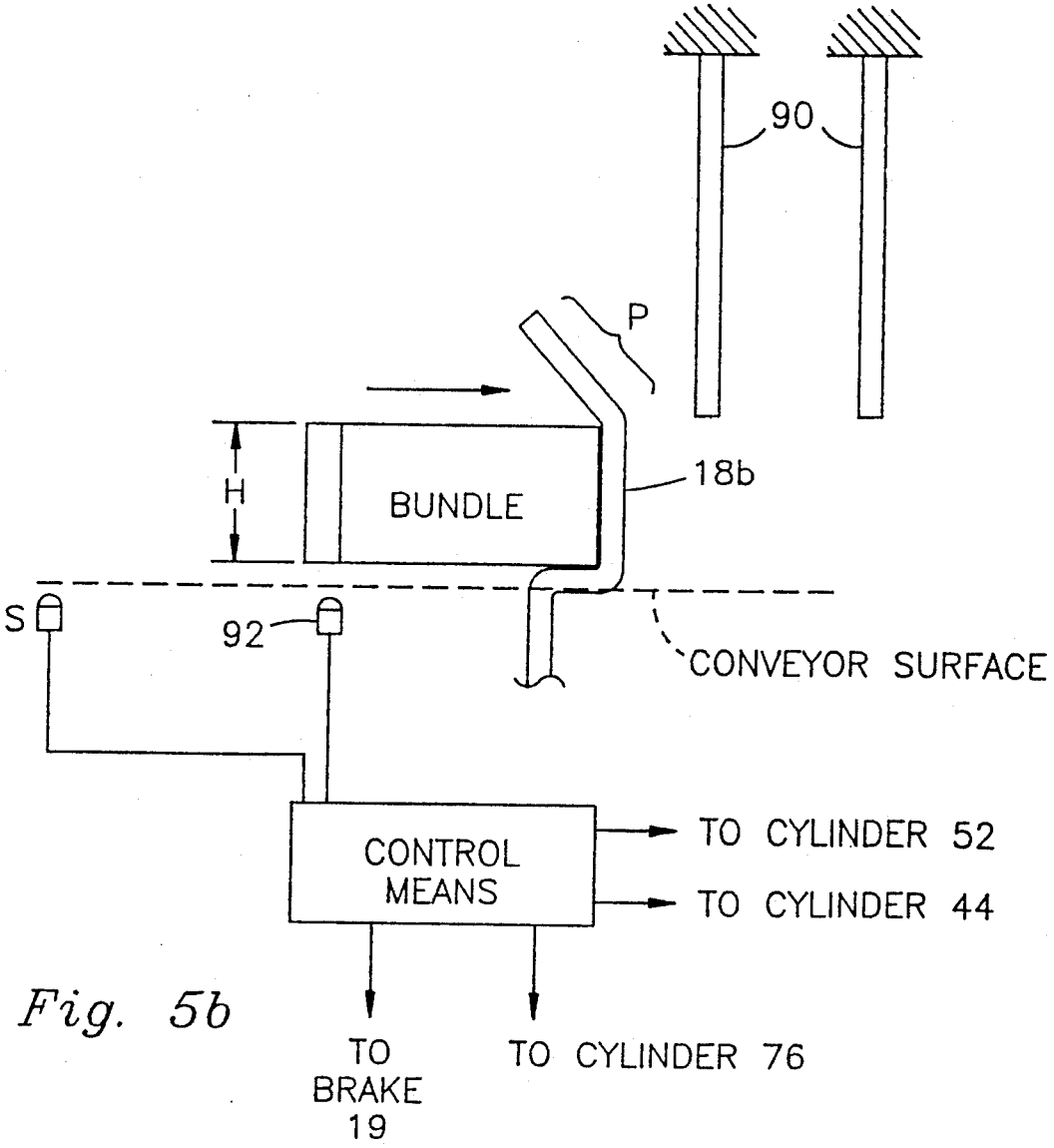

During the feeding of web **18*b* the bundle delivered thereto is transferred to the belts 56 which move the bundle toward the vertical "wall" created by the wrapping paper (FIG. 5*a*). Due to the high velocity of the bundle, it crashes into the "wall" at a speed sufficient to cause the upright wrapping sheet 18*b* to collapse whereupon the portion P of the upright wrapping sheet 18*b* (FIG. 5*a*) which extends beyond the height H of the bundle is caused to collapse and fall by gravity, wrapping the top portion of the bundle. Since the bundle travels at a velocity preferably in excess of twenty inches per second and in the range of twenty to forty inches per second, a "natural" wrapping is achieved. The preferred speed is thirty inches per second. One or more flexible belts 90 arranged preferably at and downstream relative to the exit point of the wrap machine are suspended so that they hang down over the bundle whereby the lower portions of the belts 90** stroke and wipe across the top of the bundle and serve to flatten out the portion of the wrapping sheet which falls down upon and engages the top of the bundle.

The crease cylinder 76 is operated to retract the movable crease roller at the time that the bundle crashes into the "wall" of the wrapping paper. This operation is preferred since there is no need to apply a crease to the portion of the web which engages the bottom surface of the bundle.

When the trailing edge of the bundle passes photocell 92, a signal is generated by the photocell and is applied to the electronic control means which, after a fixed delay, operates the knife cylinder to rapidly extend the piston rod **52*a***, thereby severing the web.

At the same time that the knife cylinder 52 is extended, feed cylinder 44 is operated to terminate the feeding of web **18*b***.

The web is prevented from slipping downwardly due to the cooperating back stop rollers 28 and 30 and the one-way clutch assembly 38 arranged between shaft 36 and roller 30.

As the web is being initially fed upwardly, supply roll 18 is substantially stationary. The dancer arm 20 yields, moving upwardly to allow the web to begin feeding while the inertia of the supply roll 18 is overcome. In order to prevent feeding of more web than is necessary, the brake means 19 may be provided. The brake means is operated after the movable feed rollers 40 are displaced from the stationary feed rollers 42 and the dancer arm is moved downwardly to the solid line position **20*a***.

The three-quarter wrap machine is now ready for another cycle.

The feeding of the web is accomplished so that the portion of the web which collapses upon the top of the bundle can extend over either a portion of the top of the bundle or the entire top surface of the bundle and then some, the ability to cover the top portion also being a function of the ability of the wrapping sheet to be maintained in the upward vertical position when creased by the cooperating crease rollers 62 and 80.

INK JET PRINT HEAD

An ink jet print head 100 which is mounted so that the outlet end is adjacent guide plate 24, as shown in FIG. 1, is arranged to print identifying indicia which may be any combination of alphabetic and numeric characters which are sprayed upon the web during the feeding of the web toward the wrapping position. Guide plate 24 is provided with an opening sufficient to allow the ink jet droplets which are developed and propelled by the ink jet head 100 to strike the paper web on the left-hand surface thereof relative to FIG. 1.

It can be seen that the characters generated by the ink jet head are applied to the hidden surface of the wrapping material, i.e. the surface of the wrapping material which engages the bundle. The wrapping material selected for use in the present invention has a characteristic of providing a high "bleed through" so that the characters can be seen from the opposite side of the web, i.e. the side of the web which is exposed. The ink jet module 100 employed has the capability of spraying mirror image characters which are "backwards" so to speak so that when they "bleed through" the wrapping sheet, the characters can be read in the normal fashion.

A latitude of modification, change and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein described.

What is claimed is:

1. Apparatus for wrapping a bundle comprising:
- means for conveying a signature bundle along a path and toward and through a wrapping station;
- means arranged beneath said path for feeding an elongated wrapping sheet in a generally upward direction so as to cross said path;
- means for shaping the wrapping sheet as it is being fed upwardly from said shaping means so that it is sufficiently rigid and self-supporting to feed an end of the sheet to a point above the bundle; and
- means for causing the wrapping sheet to wrap about a portion of the bundle.

2. The apparatus of claim 1 further comprising:
- means to selectively operate said shaping means so that only a selected portion of the wrapping sheet is shaped.

3. The apparatus of claim 1 wherein said shaping means imparts a crease to the wrapping sheet.

4. The apparatus of claim 1 wherein said shaping means imparts plural creases to the wrapping sheet.

5. The apparatus of claim 1 wherein said means for causing collapses said sheet.

6. The apparatus of claim 3 wherein said means for causing removes said crease.

7. The apparatus of claim 1 wherein said causing means comprises means for moving the signature bundles into the upwardly fed wrapping sheet at a velocity sufficient to cause the wrapping sheet to wrap itself about a portion of the bundle.

8. The apparatus of claim 1 wherein said means for causing comprises means arranged above said path for imparting a force to the upwardly fed wrapping sheet to cause it to collapse about a portion of the bundle.

9. The apparatus of claim 1 wherein the wrapping sheet is shaped to be substantially self-supporting and forms a self-supporting wall in the path of movement of the signature bundle.

10. A method for wrapping a bundle comprising the steps of:

providing a wrapping station at which bundles are to be wrapped;

moving a bundle along a path extending through said wrapping station;

moving a wrapping sheet generally upward from below the path to cross said path;

shaping the wrapping sheet in a predetermined manner as it is moving upwardly to provide sufficient rigidity such that a portion of the sheet is self-supporting and reaches a point above the bundle; and folding the wrapping sheet about a portion of the bundle.

11. The method of claim 10 wherein the step of shaping further comprises:

bending the sheet in a predetermined manner to cause the sheet to maintain itself in a substantially self-supporting manner.

12. The method of claim 10 wherein the step of shaping further comprises:

imparting a crease to the sheet.

13. The method of claim 10 wherein the step of shaping further comprises:

imparting plural creases to the sheet.

14. The method of claim 10 wherein the step of shaping is selectively accomplished on portions of the sheet.

15. The method of claim 10 wherein the step of folding further comprises:

moving the bundle through the position occupied by the sheet with a force sufficiently to cause the sheet to partially wrap itself about at least one portion of the bundle.

16. In an apparatus for wrapping a sheet around bundles comprising a conveyor carrying bundles along a path through a wrapping station, means for feeding a wrapping sheet adjacent one of said bundles and so as to cross said path while in the wrapping station, and means for carrying a wrapped bundle from the wrapping station, the improvement comprising:

means below the wrapping station for feeding the wrapping sheet from below the wrapping station and for shaping the wrapping sheet to provide sufficient rigidity to cause an end of said sheet to be self-supporting and rise above the bundle; and means to fold said sheet around the bundle.

17. An apparatus for wrapping a signature bundle comprising:

a conveyor forming a path for a signature bundle, said path leading to and through a wrapping station where the signature bundle is to be wrapped in a wrapping sheet; and a wrapping sheet feed mechanism located beneath said path adjacent the wrapping station for feeding one end of a wrapping sheet generally upwardly through said path to a first height above the height of a signature bundle when passing through the wrapping station along said path in timed relation thereto so that the signature bundle to be wrapped will strike the upwardly fed wrapping sheet below said one end thereof as the signature bundle passes through the wrapping station along said path, said mechanism including a shaper for shaping the wrapping sheet as it is being upwardly fed through said path into a configuration imparting a rigidity to the wrapping sheet sufficient to cause said one end of said wrapping sheet to be self-supporting and to permit said one end thereof to be upwardly fed to said first height, whereby the movement of a signature bundle moving along said path will effect the upward feeding of the shaped wrapping sheet to said first height so that the upwardly fed wrapping sheet can collapse onto and wrap the signature bundle as the signature bundle moves through the wrapping station.

* * * * *

UNITED STATES PATENT AND TRADEMARK OFFICE

CERTIFICATE OF CORRECTION

PATENT NO. : 5,274,983

DATED : January 4, 1994

INVENTOR(S) : SJOGREN ET AL.

It is certified that error appears in the above-indentified patent and that said Letters Patent is hereby corrected as shown below:

Column 6, line 59, change "18a" to --18b--

Signed and Sealed this

Nineteenth Day of July, 1994

*Attest:*

*Attesting Officer*

BRUCE LEHMAN

*Commissioner of Patents and Trademarks*